US012492048B2

(12) United States Patent
De Ruiter et al.

(10) Patent No.: US 12,492,048 B2
(45) Date of Patent: Dec. 9, 2025

(54) SPOUT-CAP UNIT, POUCH COMPRISING SUCH A SPOUT-CAP UNIT

(71) Applicant: Daklapack Europe B.V., Lelystad (NL)

(72) Inventors: Jan De Ruiter, Lelystad (NL); Dave Willem Klaassen, Lelystad (NL)

(73) Assignee: Daklapack Europe B.V., Lelystad (NL)

( * ) Notice: Subject to any disclaimer, the term of this patent is extended or adjusted under 35 U.S.C. 154(b) by 213 days.

(21) Appl. No.: 18/564,259

(22) PCT Filed: May 25, 2022

(86) PCT No.: PCT/NL2022/050289

§ 371 (c)(1),
(2) Date: Nov. 27, 2023

(87) PCT Pub. No.: WO2022/250537

PCT Pub. Date: Dec. 1, 2022

(65) Prior Publication Data

US 2024/0239564 A1 Jul. 18, 2024

(30) Foreign Application Priority Data

May 27, 2021 (NL) ..... 2028309
Aug. 2, 2021 (NL) ..... 2028901

(51) Int. Cl.
*B65D 47/14* (2006.01)

(52) U.S. Cl.
CPC ..... *B65D 47/141* (2013.01)

(58) Field of Classification Search
CPC ..... B65D 47/141; B65D 47/14; B65D 55/16; B65D 75/5883; Y02W 30/80
See application file for complete search history.

(56) References Cited

U.S. PATENT DOCUMENTS 5,301,849 A * 4/1994 Guglielmini ..... B65D 47/0814 222/541.9
5,911,340 A 6/1999 Uematsu
(Continued)

FOREIGN PATENT DOCUMENTS

DE 102007011929 A1 9/2008
DE 102019002719 A1 10/2020
(Continued)

OTHER PUBLICATIONS

International Search Report and Written Opinion, PCT/NL2022/050289, mailed Oct. 21, 2022, 19 pages.

*Primary Examiner* — Donnell A Long
(74) *Attorney, Agent, or Firm* — Stanek Lemon Crouse & Meeks, PA

(57) ABSTRACT

A spout-cap unit is provided. The spout-cap unit includes a spout including a sealboat, an outlet tube, a retaining member and a cap for closing the outlet tube in a closed position. The spout and the cap are tethered together via at least one tethering member to form the spout-cap unit, the tethering member is connected to the spout at one end and to the cap at the opposite end. The cap is releasable from the outlet tube and can be brought into a released state. In the released state, the cap and the spout remain tethered via the tethering member. The tethering member allows the cap to be moved to a retaining position away from the outlet of the outlet tube. The cap or tethering member can be coupled with the retaining member of the spout for retaining the cap at the retaining position.

17 Claims, 13 Drawing Sheets

(56) References Cited

U.S. PATENT DOCUMENTS

| | | | | |
|---|---|---|---|---|
| 8,646,633 | B2 * | 2/2014 | Huntington | B65D 47/08 220/834 |
| 11,059,633 | B2 * | 7/2021 | Gosling | B65D 47/0838 |
| 11,918,540 | B2 * | 3/2024 | Smith | A61J 1/1418 |
| 2004/0245286 | A1 | 12/2004 | Lee | |
| 2007/0205216 | A1 * | 9/2007 | Smith | B65D 77/067 222/81 |
| 2008/0197135 | A1 | 8/2008 | Berman | |
| 2016/0272379 | A1 | 9/2016 | Skillin et al. | |
| 2022/0119163 | A1 | 4/2022 | Wommelsdorf et al. | |

FOREIGN PATENT DOCUMENTS

| | | | | |
|---|---|---|---|---|
| EP | 0510388 | A2 | 10/1992 | |
| EP | 2076448 | B1 | 2/2014 | |
| WO | WO-02098756 | A2 * | 12/2002 | B65D 47/0838 |
| WO | 2004060762 | A1 | 7/2004 | |
| WO | 2008048039 | A1 | 4/2008 | |
| WO | 2017052364 | A1 | 3/2017 | |

* cited by examiner

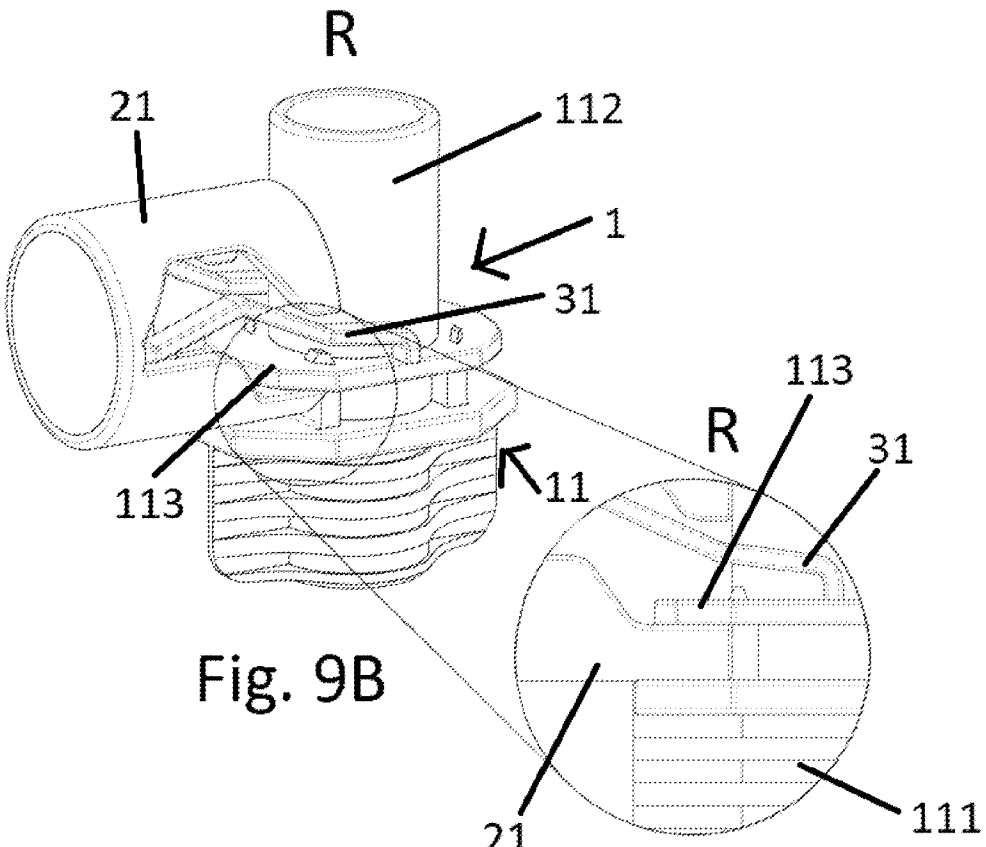
Fig. 9B
Fig. 9C
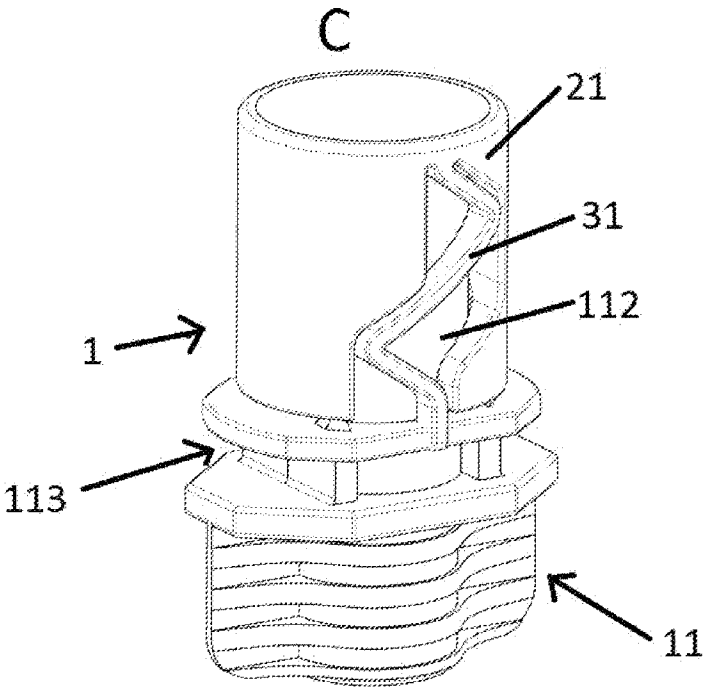
Fig. 9A

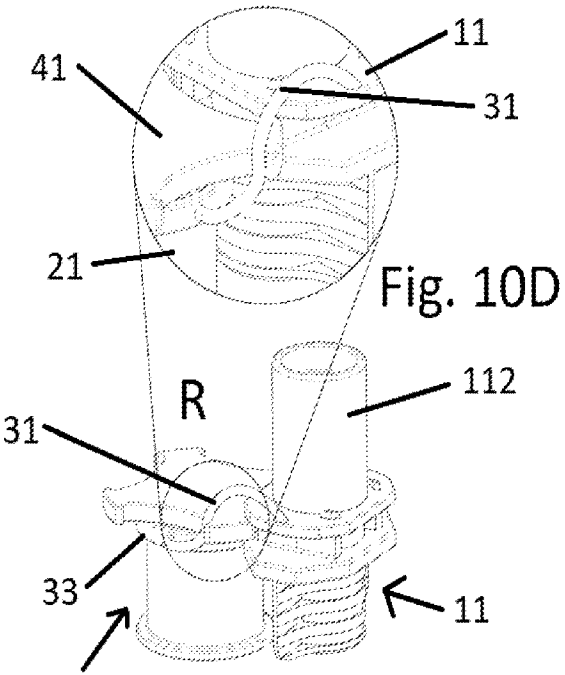
Fig. 10D
Fig. 10C
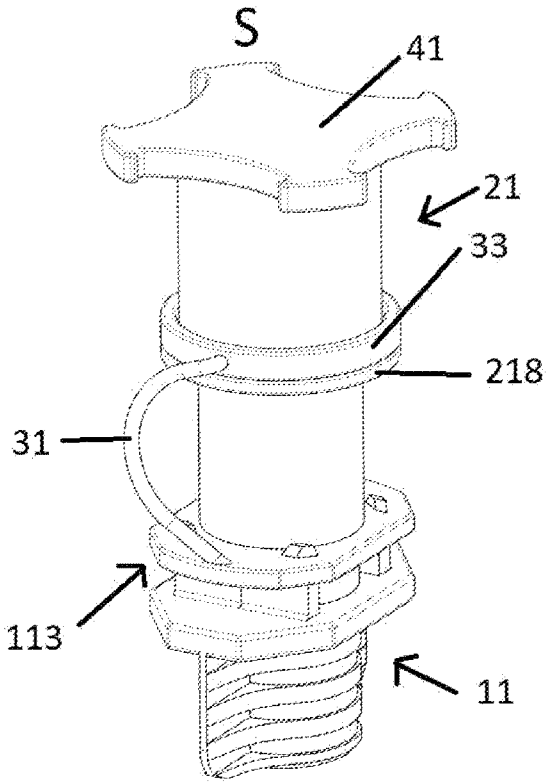
Fig. 10B
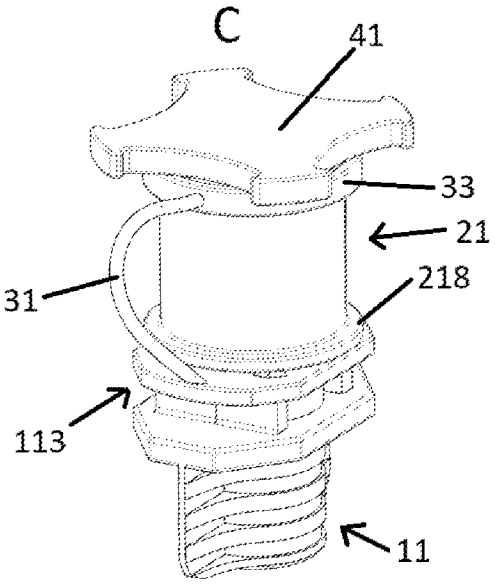
Fig. 10A

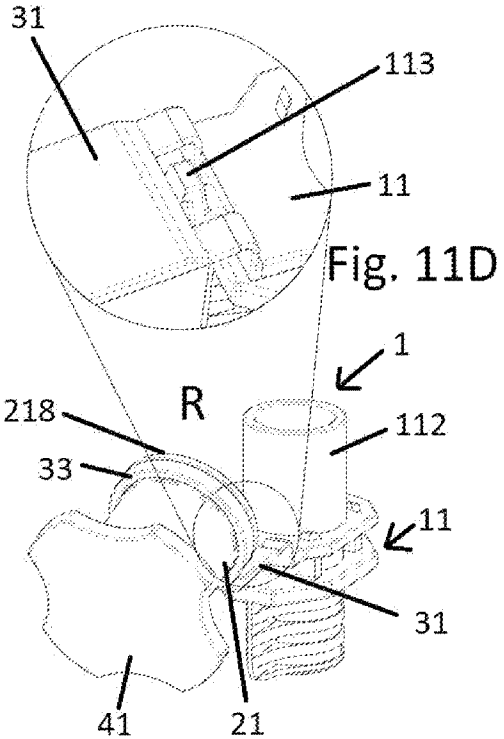
Fig. 11D
Fig. 11C
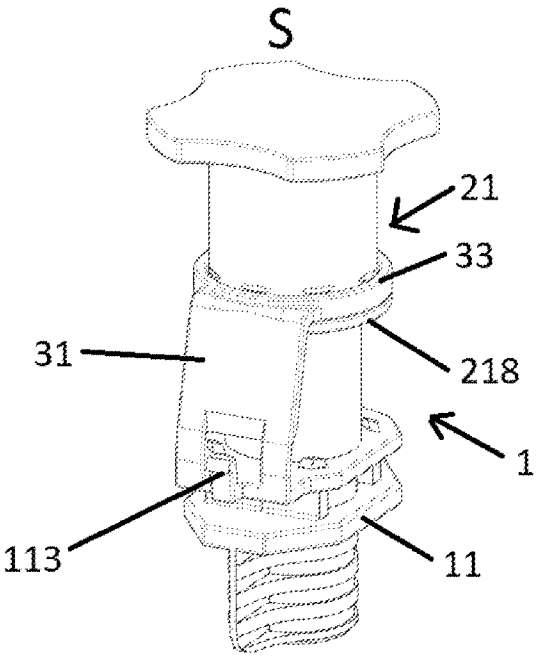
Fig. 11B
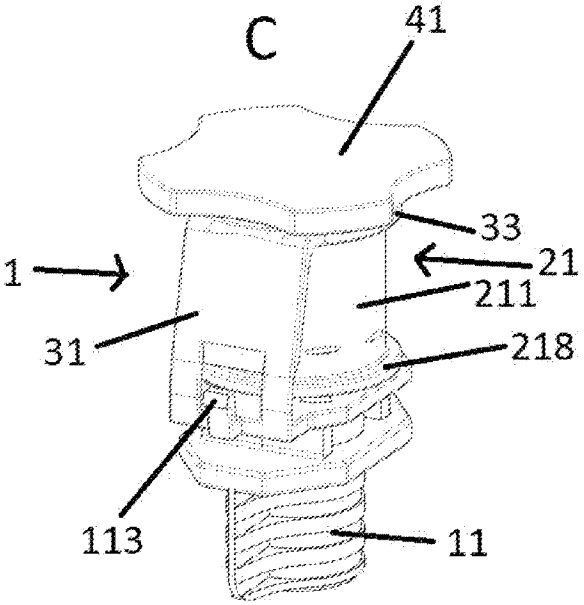
Fig. 11A

SPOUT-CAP UNIT, POUCH COMPRISING SUCH A SPOUT-CAP UNIT

CROSS-REFERENCE TO RELATED APPLICATIONS

Priority is claimed to International Application No. PCT/NL2022/050289 filed on May 25, 2022, which claims priority to Netherlands Application No. 2028309 filed on May 27, 2021, and Netherlands Application No. 2028901 filed on Aug. 2, 2021, the entire disclosures of which are hereby incorporated by reference herein.

The present inventive concept relates to a spout-cap unit including a spout part and a cap part and a pouch comprising such a spout-cap unit.

BACKGROUND

According to EU Directive 2019/904, any beverage container that is intended for single-use only may no longer contain parts—such as caps or temper evident members—that are removable from the spout when sold in the EU after 3 Jul. 2024. This Directive is aimed at reducing the amount of plastic waste in the environment.

At present, many single-use beverage containers, e.g., pouches filled with a fruit substance, yoghurt, a liquid, etc. comprise caps that are screwed on the spout and that are attached to said spout via a tamper evident closure. The cap is typically screwed on the spout after the pouch is filled with the substance, and closes the outlet tube of the spout. Once the pouch is opened by removing the cap from the outlet tube of the spout, the cap is physically disconnected from the spout. Although it can be screwed back on, often such caps end up in the environment. Examples of such spouts and caps for closing beverage containers can easily be found in the patent literature. To mention just one example, reference is made to EP2076448 A1.

Non-separable spouts and caps complying with EU Directive 2019/904 may e.g., be obtained by using a flip-top closure having a film hinge to connect cap and spout, as e.g., found on bottles comprising a liquid. For example, a film hinge is disclosed in patent application EP0510388 A1.

U.S. Pat. No. 5,911,340 relates to a spout assembly comprising a spout and a cap. The spout has a cylindrical outer tube to be placed outside a package and a base to be bonded to the inner surface of the package. The cap is separably connected to an extremity of the cylindrical outer tube coaxially with the cylinder outer tube in a position in which the cap is pushed into the cylindrical outer tube.

US 2016/0272379 A1 relates to a one-piece dispensing closure for a pouch-like container, including an integrally formed closure body, dispensing neck, hinged cap, a tamper-evident closure system and a latch for maintaining the cap in an open position. A first disadvantage of the solution of US2016/0272379 A1 is that once the closure is assembled to the pouch, it cannot be filled without breaking the tamper evident closure.

SUMMARY

Often, the cap and the spout are made of different plastic compositions. When the cap is screwed back on the spout, recycling of the two different materials can be difficult, as it is difficult to sort and distinguish the two slightly different plastic materials during recycling.

A first disadvantage of film hinges is that the cap tends to move back to the closed position when opened, and pricks into the nose of a user drinking from the bottle. This is unpleasant for the user. A second disadvantage of film hinges is that they do not solve the recycling problem, as the bottle and the cap are often made of different materials which are not easily sorted during recycling.

A first disadvantage of spout assemblies is that it is not possible and/or difficult to fill the package after the spout-and-cap-assembly has been sealed to it. The package must be filled before the spout-and-cap assembly is mounted to it. This is not always practical and deviates from the standard practice in factories around the world. This results in a relatively inefficient filling of the pouch, in the sense that more pouch material is needed for a particular volume of goods. A second disadvantage is that although the cap can be clicked on the spout in the open position of the cap, in this open position (as e.g., illustrated in FIG. 29 of U.S. Pat. No. 5,911,340) the cap remains quite close to the outlet tube of the spout so that a consumer cannot comfortably drink from the spout: the lips will contact the cap which is unpleasant. It may be uncomfortable and awkward to drink from such a spout.

A first disadvantage of US2016/0272379 A1 is that once the closure is assembled to the pouch, it cannot be filled without breaking the tamper evident closure. A second disadvantage is that although the cap may be maintained in an open position due to the latch (see e.g., FIG. 13), the position in which the cap is maintained is not very inviting and friendly for consumers to consume the contents of the pouch through the outlet tube.

Accordingly, an object of the present inventive concept is to provide a user-friendly cap-spout unit that complies with EU Directive 2019/904, i.e., of which the cap and the spout cannot be separated in normal use. Preferably, such a cap-spout unit should be made of a single material, to make recycling easier.

Another object of the present inventive concept is to provide a cap-spout unit of which the different parts cannot be separated, that can be sealed to a pouch before the pouch is filled, through which the pouch can be filled and that preferably may also comprise a tamper evident measure.

Therefore, the present inventive concept provides a spout-cap unit, comprising a spout part including a sealboat, an outlet tube and a retaining member, and a cap part for closing an outlet of the outlet tube in a closed position of the cap part, wherein the spout part and the cap part are tethered together via at least one tethering member to form the spout-cap unit, the tethering member being coupled with the spout part at one end of the tethering member and with the cap part at the opposite end of the tethering member, wherein the cap is releasable from the outlet tube of the spout part for providing the cap part in a released state, wherein in said released state the cap part and the spout part remain tethered together via the tethering member, the tethering member allowing the cap part to be moved to a retaining position that is positioned away from the outlet of the outlet tube, wherein the cap part or the tethering member can be coupled with the retaining member of the spout part for retaining the cap part at the retaining position, and wherein the cap part is composed out of at least two elements: a body element that is manufactured together with the spout part, the body element enclosing the outlet tube of the spout part in a circumferential direction, the body element coupled with the tethering member and the body element being hollow and having open ends, and a plug element manufactured separately from the spout part and the body element, the plug element for closing an open end of the body element, so that when the plug element is received in the body element, the cap part closes the outlet tube of the spout part.

An advantage of such a spout-cap unit is that the cap part may be produced along with the spout part, while having an open end after production. The spout-cap unit may then be attached to a pouch, after which the pouch may be filled through the open end of the cap. Finally, the open end may be covered in an un-releasable manner by the plug element and the product may be transported to a store/sold to a customer.

Further advantageously, the cap part and the spout part of the spout-cap unit remain coupled in both the closed position and the retaining position of the cap part, as well as in any intermediate position. Of course, when using an excessive force it may be possible to break the tethering member(s) and physically separate the spout part and the cap part. However, in normal use the cap part and the spout part remain coupled, thereby complying with EU Directive 2019/904. In various embodiments, after having opened the cap and placing it in the retained position to consume a consumable from the pouch or container of which the spout-cap unit is a part, the cap can be placed back on the outlet tube to close the outlet again.

Further advantageously, the retaining position is located away from the outlet of the outlet tube, and the cap or tethering member is coupled with the retaining member to retain the cap in the retaining position. At this retaining position, the cap is temporarily fixed at a position away from the outlet of the spout—either directly by coupling the cap itself with the retaining member, or indirectly by coupling the tethering member with the retaining member—so that the cap does not hinder a user when consuming the contents of the pouch to which the spout-cap unit will typically be sealed. For example, the coupling of the cap or tethering member with the retaining member can be achieved by clicking the cap on the retaining member, by hooking the cap under the retaining member, or by pressing the cap on the retaining member. For example, the tethering member can be coupled with the retaining member.

Further advantageously, the plug element may make the cap-spout unit customizable. By altering the shape and/or colour of the plug element and/or by incorporating an imprint such as a logo thereon, a completely different look and feel may be given to the entire cap-spout unit. This all can be done by altering a cheaply to make component and without altering the cap-spout unit. Thereby many variations of the closure system may be made at relatively low costs and/or in small series. At the same time, the plug element may have relatively large dimensions, much larger than presently seen caps so that it may be easily operated by children and/or elderly persons, while still allowing the spout to be processed by standard-sized factory equipment for the purpose of sealing it to a pouch and/or for filling the pouch. The plug element may be added to the spout-cap unit only after such standard process steps, using standardized equipment, are successfully executed.

The present inventive concept further provides a spout-cap unit, comprising a spout part including a sealboat, an outlet tube and a retaining member and a cap part for closing an outlet of the outlet tube in a closed position of the cap part, the cap part comprising a flange at its lower edge, a radial projection at its upper edge, and a body element in between, wherein the spout part and the cap part are tethered together via at least one tethering member to form the spout-cap unit, the tethering member being connected to the spout part at one end of the tethering member and comprising a ring element that encloses the cap part at the opposite end of the tethering member, wherein the cap part is upwardly moveable with respect to the outlet tube of the spout part and is releasable therefrom for providing the cap part in a released state, wherein in said released state the cap part and the spout part remain tethered together via the ring element of the tethering member, the tethering member allowing the cap part to be moved to a retaining position that is positioned away from the outlet of the outlet tube, wherein the tethering member can be coupled with the retaining member of the spout par for retaining the cap part at the retaining position.

In general, the longer the outlet tube the more pleasant it is for a consumer to consume a good therethrough, but the more difficult it is to allow the cap to be removed from the outlet tube (when relying on some sort of hinge mechanism and not screw thread). Advantageously, the implementation of the ring element along which the cap may be moved allows the use of a relative long outlet tube on the spout, of up to 13 or 14 mm, for example, while still allowing the cap to be removed from the outlet tube and keeping overall proportions minimal or reduced.

Because of the ring element, the protrusion on the upper edge of the cap and the flange of the lower edge of the cap, the cap may be moved up and down with respect to the ring element/outlet tube without it becoming detached from the spout. This has the effect that one can initially pull the cap upwards with respect to the outlet tube, remove the cap from the outlet tube, and then move it away from the outlet tube.

This leads to another advantage, as in the retained position the cap can be slid down again with respect to the ring element, so that the cap is very far away from the outlet tube, possibly entirely below the outlet tube. With the cap in such a position a consumer can drink from the outlet tube in a highly friendly and convenient manner.

According to the present inventive concept, the spout-cap unit comprises a spout part. A spout is an element well known to those skilled in the art of single-use plastic containers, such as pouches. A spout is typically sealed to a pouch before or after the pouch is filled with a consumable good (which consumable good can be a food product, or a non-food product). All known spouts comprise at least a sealboat, to which the pouch is sealed and an outlet tube, through which the consumable good in the pouch is consumed by a user.

As explained in the above, when filling the pouch the outlet tube may be used as an inlet, particularly when the spout is sealed to the pouch before the pouch is filled. The consumable product is then typically introduced in the pouch through the outlet tube of the spout, which then thus functions as an inlet tube. However, to the end consumer it is an outlet tube, through which the consumable good comes out of the spout/pouch.

According to the present inventive concept, the cap part of the spout-cap unit, in a closed position, closes the outlet of the outlet tube. Also a cap is an element well known to one skilled in the art of single-use plastic containers. Typically, on presently available single-use plastic pouches the cap is screwed on the spout and must be unscrewed to open the pouch. It is noted that such a screw connection may not be implemented on the spout-cap unit according to the present inventive concept.

According to the present inventive concept, the spout part and the cap part are tethered together via at least one tethering member. The tethering member is e.g., a line, wire or hinge element of injection-moulded material, that is formed at the same time, i.e., in a single mould together with, the cap and the spout. The tethering member will typically be of the same material as the spout part and the cap part. The tethering member may typically not prevent separation of the spout and the cap from each other under all circumstances. For example, one willing to do so may separate the spout and the cap by cutting the tethering member or by snapping the tethering member by pulling on the cap. However, in normal operating conditions, where the cap is manipulated with some care, the spout and cap should remain attached to each other via the tethering member. The tethering member effectively forms a flexible bridge between the spout part and the cap part, joining the two together.

The area in between the inner surface of the cap part and the outer surface of the outlet tube is preferably substantially empty, the inner surface of the cap being substantially free (i.e., spaced apart) from the outer surface of the outlet tube, allowing the cap part to be released from the outlet tube. Compared to the closed position, wherein the cap covers the outlet tube, when the cap is removed from the outlet tube it is in a released state.

The tethering member preferably has a flexibility that allows the cap, once it is released from the spout, to be brought to a retaining position away from the outlet of the outlet tube. In embodiments, the tethering member may act as a hinge or spring that allows the cap to transfer to the retaining position once released from the outlet tube, or even urges the cap towards said retaining position.

In embodiments the retaining position is defined by a retaining member. The retaining member is e.g., formed on the spout, and allows the cap or the tethering member to be coupled with the spout at the retaining position.

For example, the retaining member may have a shape that substantially matches the inner circumference of the cap part, so that the cap part can be clicked on the retaining member.

For example, the retaining member may define a protrusion, under which the cap or tethering member can be clamped or secured.

For example, the retaining member may define a protrusion, on which the cap can be clamped.

In other embodiments the tethering member is coupled with the retaining member to retain the cap at a position away from the outlet tube.

Even though EU Directive 2019/904 refers to single use containers only, it should be noted that the spout-cap unit as disclosed herein is also advantageous on containers which are intended for multiple use, especially if the cap can be reliably placed back in the closed position again. In other words, the present inventive concept is not limited to only spouts-cap units forming a part of single-use containers.

In various embodiments of the present inventive concept the plug element, on the side facing the cap part, comprises at least two concentric annular grooves, each defined by a respective outer wall and a respective inner wall, wherein the first of the at least two concentric annular grooves is arranged at the radially outer side with respect to the other of the at least two concentric annular grooves and is configured for a non-releasable connection with body element of the cap part, whereas the second of the at least two concentric grooves is arranged at the radially inner side and configured for a releasable connection with the outlet tube of the spout part. Advantageously, the first of the concentric grooves ensures that the plug element and the body element of the cap remain connected and EU Directive 2019/904 is complied with, while still allowing the pouch to be filled after the spout-cap unit is sealed to it. Advantageously, the second groove allows the cap to be placed back on the outlet tube again, to (temporarily) close the outlet tube, e.g., because the contents of the pouch have not yet been consumed fully.

In an embodiment of the present inventive concept the inner wall of the first annular groove is longer than the respective outer wall thereof and/or the inner wall of the second annular groove is longer than the respective outer wall thereof.

In an embodiment of the present inventive concept the inner wall of the first groove equals the outer wall of the second groove. This advantageously minimizes the amount of material to be used in manufacturing the plug element and additionally simplifies the mould in which the plug element may be made.

In an embodiment of the present inventive concept the inner wall of the second groove has a non-constant cross-sectional shape, with a circumferential recess at its radially outer surface, for receiving a circumferential protrusion arranged on the radially inner surface of the outlet tube. Advantageously, this may ensure an even better and more reliable placement of the cap back on the outlet tube after the spout has been opened for the first time.

In an embodiment of the present inventive concept, a distance between the flange and the radial projection of the cap exceeds 8 mm. This advantageously ensures that the cap may be positioned relatively far away from the outlet tube in the retained position, so that the outlet tube is freed as good as possible and drinking therefrom is as pleasant as possible.

In an embodiment of the present inventive concept, the cap part and the spout part are made from the same material. This may allow the spout part and the cap part to be made in one injection mould, in just a single process step. This may allow the spout part and the cap part to be recycled in an effective manner, as the material of the cap needs not be separated from the material of the spout, but can be processed in the same stream when the two are made from the same material.

In an embodiment of the present inventive concept, the spout-cap unit is injection moulded. Injection moulding is the present day standard for manufacturing spouts and caps, and the spout-cap unit as presented herein can quite easily be injection moulded. However, it is not excluded that in the future other manufacturing techniques may be competitive with injection moulding in terms of speed and cost price. It is expected that also such techniques are capable to produce a spout-cap unit as presented herein.

In an embodiment of the second aspect, the spout-cap unit may be made as a single part. This is mainly advantageous when the spout-cap unit is sealed to a pouch after the pouch is filled with a consumable product. In such an embodiment, the cap fully circumvents the outlet of the outlet tube, in both the radial and the axial direction, when the unit is manufactured.

In an embodiment of the present inventive concept an upper edge of the cap unit, as e.g., formed by the plug element has a diameter that is larger than a diameter of a body of the cap, the cap furthermore having a flange near its lower edge. A ring element circumvents the body of the cap at the outer side of the body and is moveable between the upper edge of the cap and the flange. The tethering member is connected to this ring element. Due to the moveability of the ring member along the body of the cap, this allows the combination of cap and tethering member to move a relatively large distance with respect to the spout even when a relatively small tethering member is used. This ensures that the outer dimensions of the cap-spout unit can be minimized.

In an embodiment of the present inventive concept the cap part and the spout part are free from screw thread. Instead the space between the inner surface of the cap and the outer surface of the outlet tube may be substantially vacant. To prevent the cap and the spout from accidental disengagement, the tethering member is provided. Preferably, before the cap is opened, also tamper evident elements may physically connect the cap to the outlet tube. In embodiments where the container (pouch) is for multiple-use, preferably the cap can be placed back on the spout, the cap then closing the spout reliably again.

In an embodiment of the present inventive concept, the outer dimensions of the cap part and the tethering member do not exceed a width of 24 mm and/or do not exceed a height of 19 mm. Presently used spouts are typically transported on rails, having an inner dimension of 24 mm width×19 mm height. To allow easy market adaption of the presently disclosed spout-cap unit, transportation in the same rail should advantageously be possible.

In an embodiment of the present inventive concept, a tamper-evident connection further connects the spout part and the cap part to each other when the cap part has been unopened. Preferably, said tamper evident connection is visible when the cap part is unopened. For example, this can be achieved by injection moulding one or more relatively thin—and thus: weak—bridge lines from the outer surface of the cap part to the outer surface of the spout part, e.g., the outlet tube.

In an embodiment of the present inventive concept, the spout part comprises a ramp at the surface that faces the bottom opening the cap part, and the edge of the cap part that faces the ramp of the spout part comprises a notch, a shape of the notch matching the shape of the ramp. This will help to twist open the spout-cap unit more easily. Preferably, said notch has a substantially straight edge at one end thereof. This makes it advantageously very intuitive for a user which direction to turn the cap into with respect to the outlet tube to open the cap.

In an embodiment of the present invention concept, the retaining position of the cap part is located to the side and/or below of the closed position of the cap part. Preferably and advantageously, the outlet of the outlet tube is freed up as much as possible, to make it as pleasant as possible to allow a consumer to consume the contents of the pouch.

A third and fourth aspect of the present inventive concept relates to a pouch comprising a spout-cap unit as described in the above. Advantages of such a pouch are the same as advantages of the spout-cap units according to the first and second aspect of the present inventive concept. Besides a pouch, the spout-cap unit may in principle by connected to any container containing a liquid, gaseous, granular or other substance.

BRIEF DESCRIPTION OF THE FIGURES

These and other aspects of the present inventive concept will now be elucidated further with reference to the attached figures, wherein the same reference numerals denote like or the same elements of the spout-cap unit. In these figures:

FIGS. 9A to 9C schematically show an eight embodiment of the spout-cap unit according to the disclosure;

FIGS. 10A to 10D schematically show a ninth embodiment of the spout-cap unit according to the present inventive concept;

FIGS. 11A to 11D schematically show a tenth embodiment of the spout-cap unit according to the present inventive concept;

DETAILED DESCRIPTION OF THE FIGURES

Figure 1A:
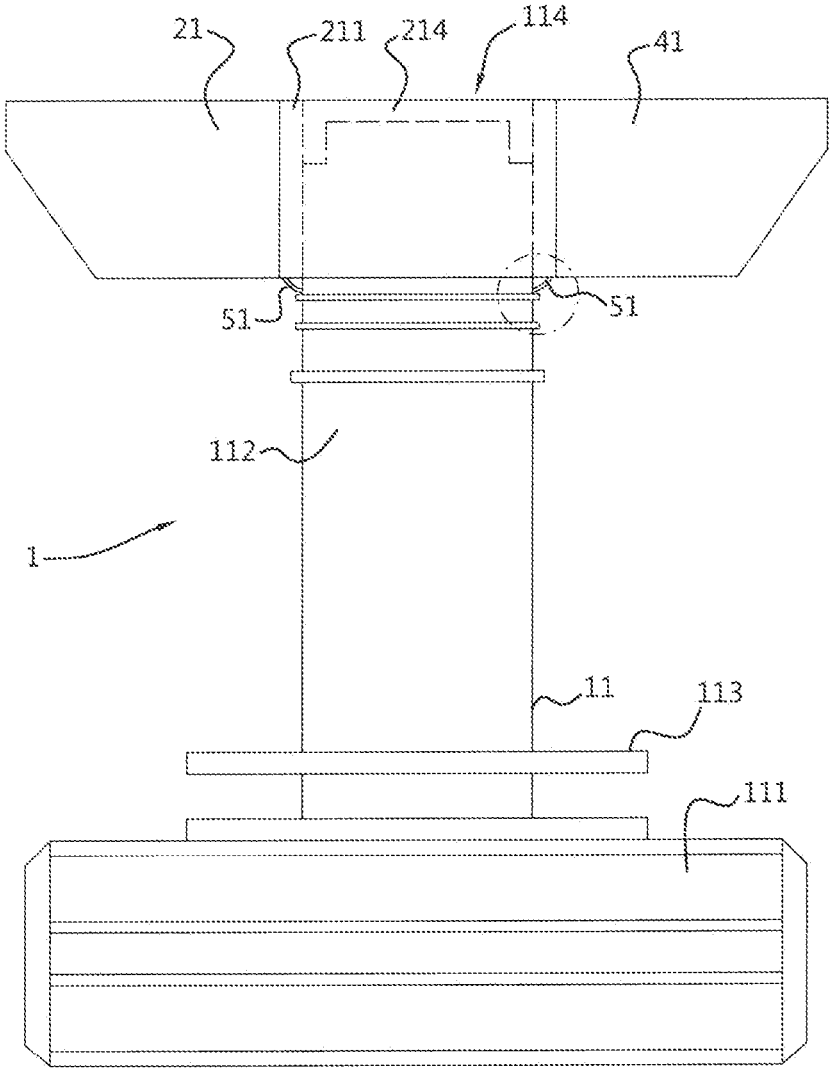
FIGS. 1A and 1B schematically show a frontal view of a first embodiment of the spout-cap unit according to the present inventive concept.

With reference to FIG. 1A initially, shown is a spout-cap unit 1 comprising a spout 11 and a cap 21. The spout 11 comprises a sealboat 111, against which a pouch can be sealed to form a pouch with an outlet. The spout 11 further comprises an outlet tube 112. Outlet tube 112 and sealboat 111 are formed integrally with each other. When the pouch is sealed to the sealboat 111 and the pouch is filled with a consumable, the consumable can be removed from the pouch through the outlet tube 112. The outlet tube 112 comprises an outlet opening 114, through which the consumable leaves the spout 11. As will be familiar to one working in the field of spouts and pouches, the pouch can also be filled through the outlet tube 112, which then for the purpose of filling the pouch also serves as an inlet tube.

The spout 11 also comprises a retaining member 113, the function of which will become more clear with reference to FIG. 2 described in the below.

The cap 21 closes off the outlet 114. The cap 21 fully surrounds the outlet 114 in the circumferential direction, and also has a closed upper surface. The cap 21 is assembled from a body element 211, manufactured integrally with the spout 11, and a plug element 214, manufactured separately from the spout 11 and clamped into the body element 211. In one possible filling method, for example, after the spout 11 and body element 211 are manufactured in a single manufacturing step, the spout 11 body element 211 combination is sealed to a pouch. The pouch is filled with a consumable through the outlet tube 112 (which for that purpose functions as an inlet tube). The body element 211 circumvents the outlet opening 114 in the radial direction, but leaves open the outlet opening 114 in an axial direction so that the pouch can be filled. After filling, to reliably close the outlet opening 114, plug element 214 is pressed into body element 211, preferably in an unreleasable manner, to form the cap 21. In the position shown, the cap 21 is in a closed position, closing the outlet 114 of the spout 11.

Further shown in FIG. 1A is grip element 41, substantially wing-shaped, which allows the user to more easily grab the cap 21 and twist it to open it. The grip element 41 can be formed integrally with the cap 21, or the grip element 41 can be separately manufactured, to be attached to the cap 21 e.g., after the pouch is filled.

Preferably, as the spout 11 and the body element 211 are made at the same time, e.g., in the same injection mould in a single injection moulding step, they are made from the same material. This makes it easy and cost-efficient to manufacture the spout 11 body element 211 combination. Preferably also the plug element 214 is made of said material, and preferably also the grip element 41 is made of the same material. Although in principle different materials could be chosen for the plug element 214 and the grip element 41, when making these of the same material as well, recycling of the spout-cap unit 1 as a whole is easier.

As an alternative to using a plug unit 214 to be inserted into body element 211 to close off the outlet tube 114 (after filling the pouch), the cap unit 21 can also be made as one part, preferably in one injection moulding step together with the spout 11. This would mostly be applied when the spout-cap unit 1 is sealed to a pouch after the pouch is filled with a consumable, and when the outlet tube 114 does not need to act as an inlet tube as well.

Figure 1B:
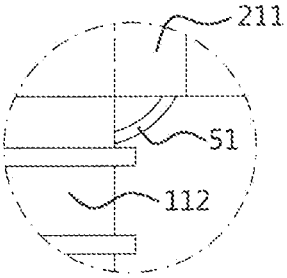

The body element 211 and the outlet tube 112 are connected to each other via tamper evident members 51, which is better shown in the exploded view of FIG. 1B. Thus, the tamper evident members 51 connect cap 21 and spout 11. The tamper evident member 51 connects on one end to the outer surface of the outlet tube 112, and on the other end to the outer surface of the body element 211. When the tamper evident members 51 are connected to both cap 21 and spout 11, the user can rely on the fact that the outlet has not been opened after production of the spout-cap unit 1, hence that the contents of the pouch have not been tampered with.

Figure 2:
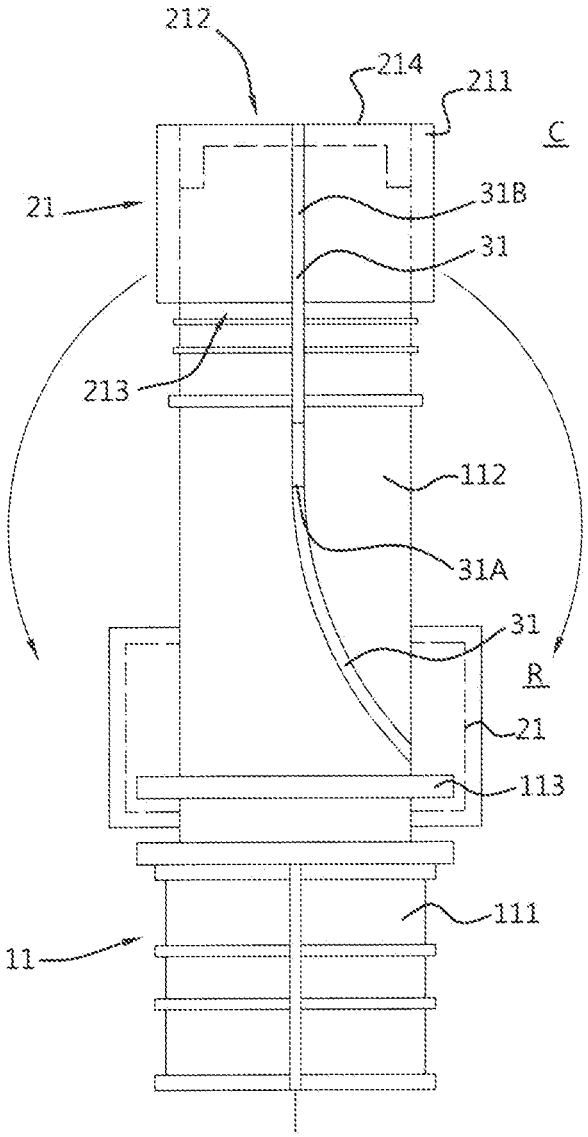
FIG. 2 schematically shows a side view of a second embodiment of the spout-cap unit according to the present inventive concept, with the cap in both the closed as well as the retained position.

Turning now to FIG. 2, FIG. 2 shows a tethering member 31. The tethering member 31, like the tamper evident member 51, connects the cap 21 to the spout 11. However, unlike the tamper evident member 51, tethering member 31 remains connected to the spout 11 and the cap 21 when the cap 21 is opened, i.e., removed from the outlet tube 112 of the spout 11. The tethering member 31 may e.g., be shaped as a wire connection, having one end 31A connected to the spout 11 and an opposite end 31B connected to the cap 21. Even though it will typically be possible to break the tethering member 31 when an excessive amount of force is applied to it, or when it is e.g., cut with a knife, a blade or another sharp item, in normal use the tethering member 31 connects the cap 21 and the spout 11 at all times, in both the closed position C as well as in the retained position R. As shown, in the closed cap position C, wherein the cap 21 closes off the outlet 114 of the outlet tube 112, the tethering member 31 connects spout 11 and cap 21 so that they form a spout-cap unit 1. Also in the retaining position R, the cap 21 and the spout 11 remain connected via tethering member 31. While connecting cap 21 and spout 11, the tethering member 31 allows the cap 21 to be moved away from its closed position C, towards a retaining position R below the closed position C and to the side of the closed position C as shown, exposing the outlet 114 of the outlet tube 112 so that a user can e.g., drink the consumable of the pouch. At the retaining position R, the cap 21 is coupled with retaining member 113 of the spout 11. In the presently shown embodiment, the cap 21 is clicked on the retaining member 113. Preferably, the tethering member 31 is shaped in such a way that a compressive or tensile force is enacted on the cap 21 when the cap 21 is in the retained position R, so that the cap 21 remains in the retained position R more securely.

Figure 3:
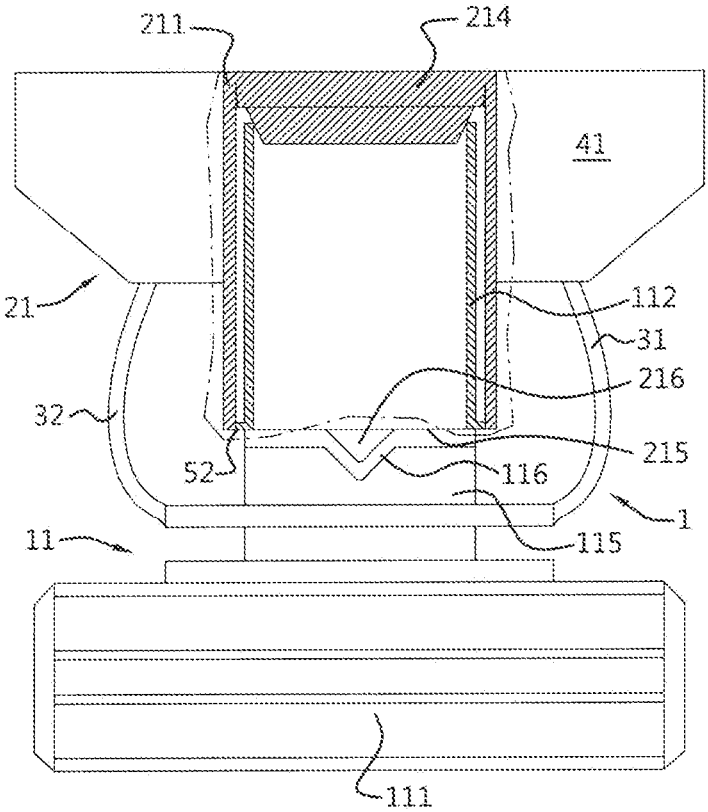
FIG. 3 schematically shows a partially open-worked view of a third embodiment of the spout-cap unit according to the present inventive concept.

Turning now to FIG. 3, an embodiment of the spout-cap unit 1 is shown. In FIG. 3, the part where the outlet tube 112 and the body element 211 of cap 21 are arranged over one another is worked open, to explain how the unit 1 can be made via an injection moulding process. As visible from FIG. 3, and as preferred, outlet tube 112 and cap 21 are substantially spaced apart from each other. There is no screw thread at which the cap 21 and the outlet tube 112 physically connect, and there are very few points of contact between the cap 21 and the outlet tube 112. While this lack of contact between cap 21 and outlet tube 112 makes it relatively easy to remove the cap 21 from the outlet 114, it raises difficulties in terms of manufacturing the unit 1, especially in a single injection moulding step.

The only point where the body element 211 and the outlet tube 112 are connected is the tamper evident seal 52, here located at the inner side of the cap 21, in between cap 21 and outlet tube 112. The tamper evident seal 52 of the embodiment shown here is too small to allow all material of the cap 21 to be reliably injected for the formation of body element 211 of cap 21 when a single injection moulding step is desired. However, when the tamper evident members are e.g., arranged at the outside of the cap 21, they may be large enough to allow the material of the body element 211 to be filled therethrough during injection moulding.

Further shown in FIG. 3 is a notch 216, protruding with respect to a lower edge 215 of the cap 21. The notch 216 is received in a ramp 116 arranged in the surface 115 of the spout 11 that faces the lower edge 215 of the cap 21.

Figure 4:
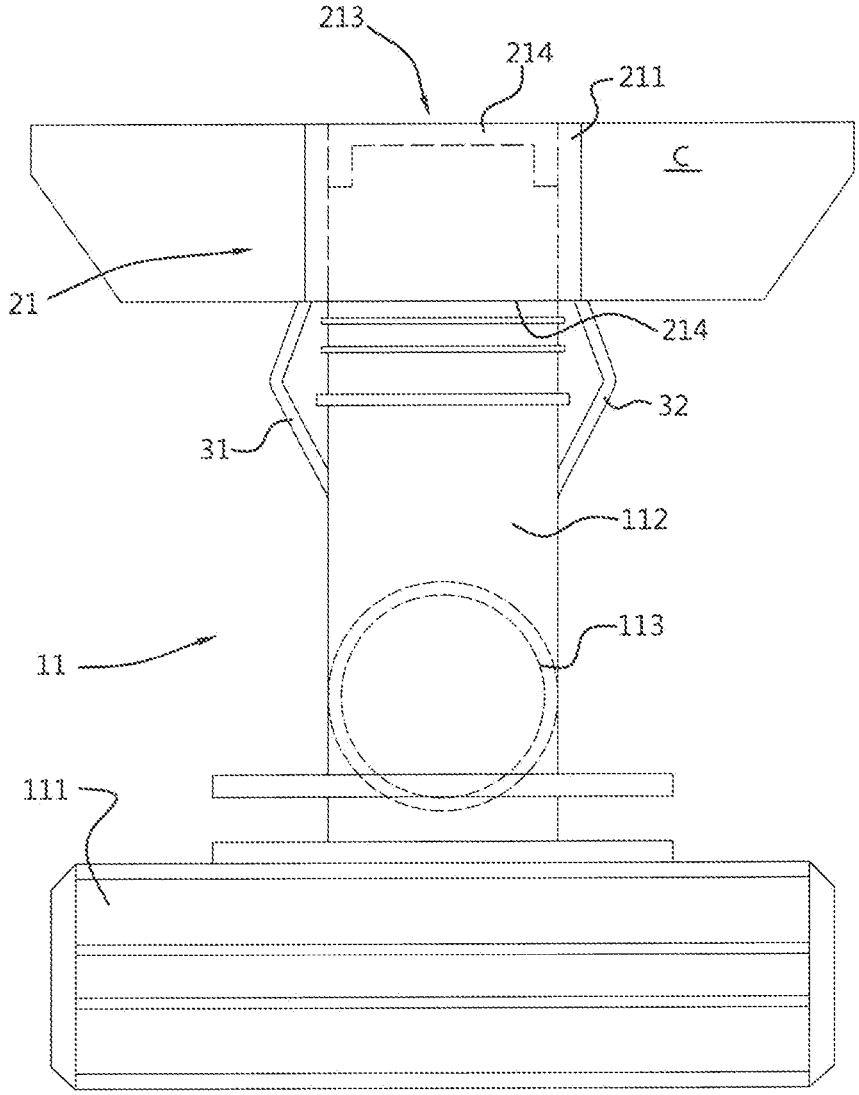
FIG. 4 schematically shows a frontal view of a fourth embodiment of the spout-cap unit according to the present inventive concept.
Figure 5:
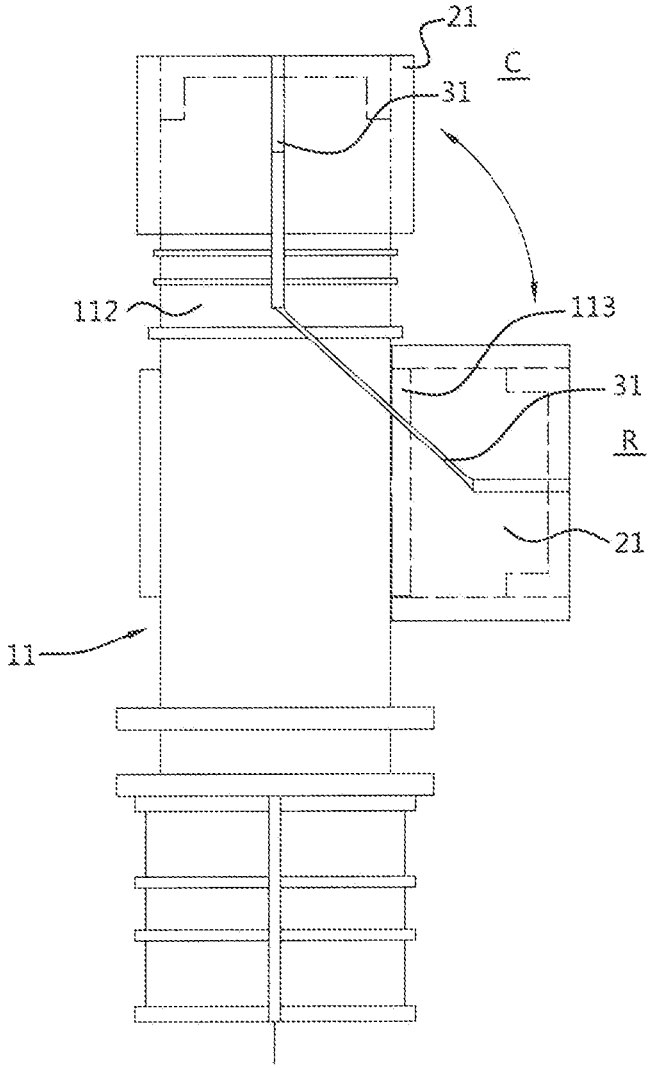
FIG. 5 schematically shows a side view of the spout-cap unit according to FIG. 4, with the cap in the closed position as well as the retained position.

Turning now to FIGS. 4 and 5, which are described in conjunction, a further embodiment of a retaining member 113 is shown. Here the retaining member 113 is circular, having an outer circumference that substantially matches the inner diameter of the bottom opening 214 of the cap 21. In FIG. 4, the retaining member 113 is shown in a frontal view, with cap 21 in the closed position C and the tethering members 31, 32 connecting cap 21 and spout 11. In FIG. 5, the cap is shown in both the closed position C as well as the retained position R, with the tethering members 31, 32 connecting the cap 21 and the spout 11 in each of the closed position C and the retained position R. In various embodiments, it is possible that the cap 21, once opened, can be placed back on the outlet tube 112, with the cap 21 again reliably closing the outlet 114.

As shown in FIG. 4, there may be two tethering members 31, 32. When two tethering members are present, the movement of the cap 21 with respect to the spout 11 is limited. In the present example, the cap 21 can only be moved in a direction in and out of the paper once the cap 21 is released from the outlet 112. However, in principle one tethering member 31, 32 will suffice to perform the tethering function of coupling the cap 21 and spout 11 in both the closed C and the retained R position. When there are two tethering members 31, 32, they preferably have same lengths, as shown here.

As shown in FIG. 5, there may be two retaining members 113, one on the right (where the cap 21 is placed) and one on the left. In such an embodiment, a user can choose where the cap 21 is placed in the retained position R. In principle, one retaining member 113 will however be sufficient.

Figure 6:
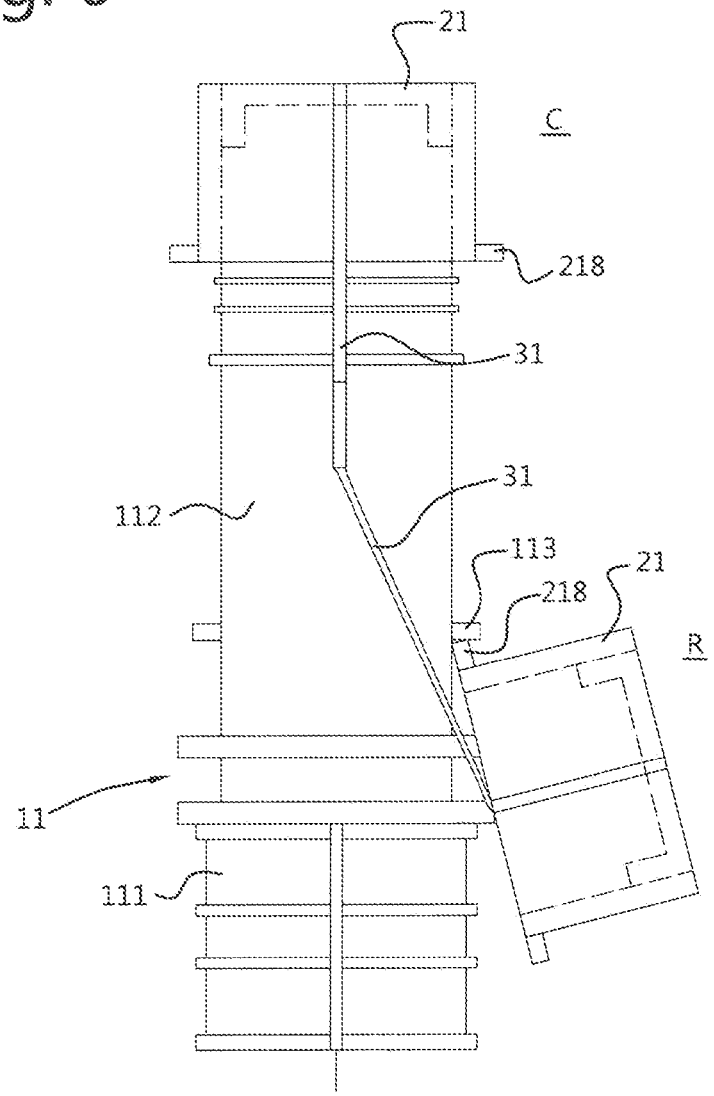
FIG. 6 schematically shows a side view of a fifth embodiment of the spout-cap unit according to the present inventive concept, with the cap in the closed position as well as the retained position.

Turning now to FIG. 6, a yet further embodiment of the spout-cap unit 1 is shown. Here, the retaining members 113 are formed as projection members on the outlet tube 112. The cap 21 comprises a flange 218 near the lower edge thereof. When moving the cap 21 to the retaining position R, the flange 218 can be hooked under the protrusion 113, to retain the cap 21 in the retained position R. Preferably, some tension force is applied on the cap 21 in such an embodiment by the tethering member 31, so that the cap 21 is reliable secured in the retaining position R.

Figure 7:
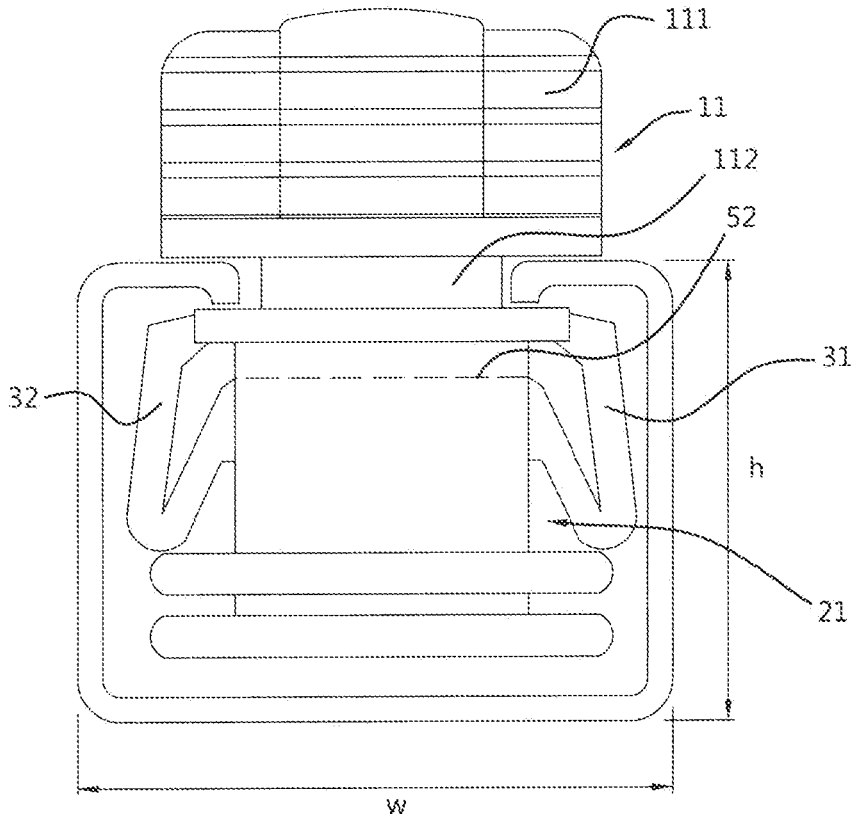
FIG. 7 schematically shows a sixth embodiment of the spout-cap unit according to the present inventive concept, on a transport rail.

FIG. 7 shows a yet further embodiment of the spout-cap unit 1. In this embodiment, dimensions of the tethering members 31, 32 and the cap 21 are reduced or minimized to ensure that the spout-cap unit 1 fits in the same transport rail as used from transporting 'ordinary' spouts. As such, the width w of the spout-cap unit 1 is maximized at 24 mm, for example, whereas the height of the cap part 21 of the spout-cap unit 1 is maximized at 19 mm, for example.

Figure 8B:
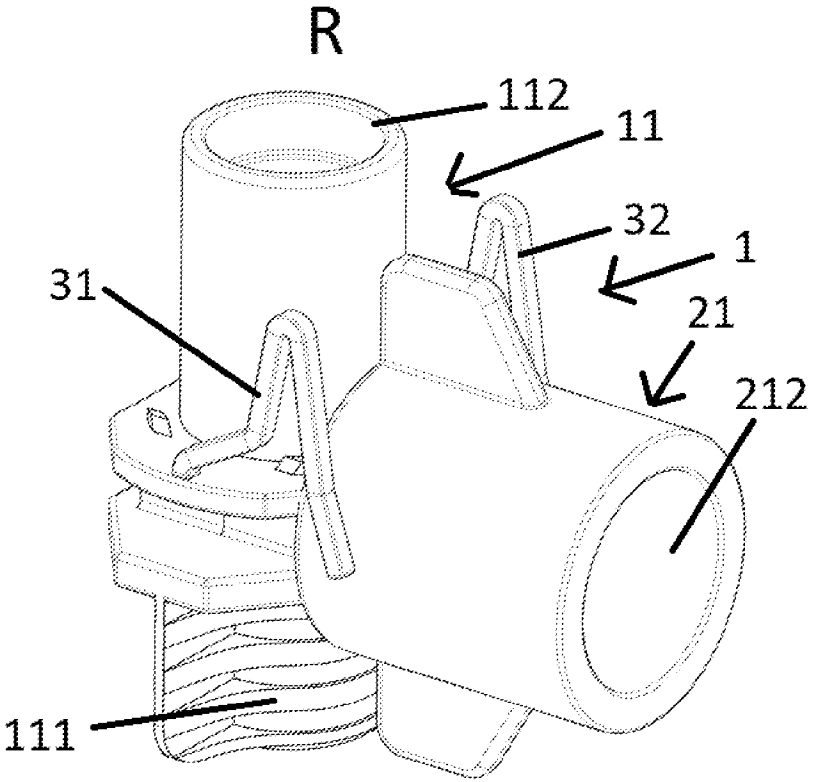
FIGS. 8A and 8B schematically show a seventh embodiment of the spout-cap unit according to the present inventive concept.
Figure 8A:
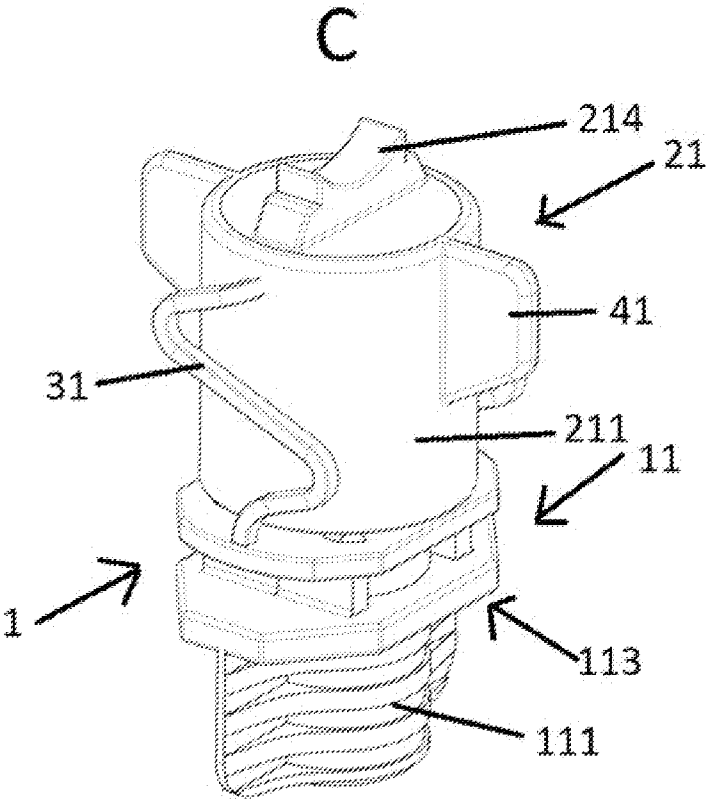

FIGS. 8A and 8B show a further embodiment of the spout-cap unit 1. The tethering member 31 is here generally W-shaped and connected to the spout unit 11 on one end and to the cap unit 21 on the other end. The generally W-shaped form of the tethering member 31 allows the cap 21 to be easily pulled upwards from a closed position C as indicated in FIG. 8A to a released position. From the released position the cap 21 may be mounted on the retaining member 113 indicated in FIG. 8B to bring the cap 21 into its retained position. The W shape of the tethering member 31 provides a sufficient length to release the cap 21 from the spout 11. When in the retained position, as indicated in FIG. 8B, the open end of the cap 21 faces away from the spout 11, while the closed end of the cap 21 engages with the retaining member 113. More specifically, the closed end of the cap is clamped in position at the retaining member 113.

The embodiment shown in FIGS. 9A to 9C is comparable to the embodiment shown in FIGS. 8A and 8B, with the difference that the cap part 21 has a cut-out. The tethering member 31 is housed in said cut-out. This has the technical advantage that the tethering member 31 is less prone to breaking and being damaged while being transported and on a shelf of a store. It can have the further technical advantage that when the cap 21 is turned 90 degrees compared to its closed position (closed position C shown in FIG. 9A; turned position shown in FIG. 9B), a protruding lip is formed. This lip can then easily and reliably be coupled with retaining member 113 to position the cap 21 in the retaining position R. Note that, further in contrast with the embodiment of FIGS. 8A and 8B, in the embodiment of FIG. 9B the open, lower end of the cap 21 engages with the retaining member 113 to retain the cap 21.

Turning now to FIGS. 10A to 10D, a ring member 33 is visible. The ring member 33 encloses a body portion of the cap 21, the ring member 33 being enclosed in between a flange 218 at the lower edge of the cap 21 and grip element 41 at the upper edge of the cap 21. Attached to the ring member 33 is tethering member 31, the tethering member 31 in this way being coupled with the cap 21. As follows from a comparison of FIGS. 10A, 10B and 10C, body portion of the cap 21 can move up and down with respect to the ring element 33, so that the cap 21 can be pulled from the outlet tube 112 of the spout 11 without needing to stretch the tethering member 31 too much (FIG. 10B) as the ring member 33 remains at a stationary position compared to outlet 112 as the cap 21 moves upwards. In that process, ring member 33 moves from a position adjacent the grip member 41 to a position adjacent flange 218. This means that the tethering member 31 can be of a relatively short length, while still allowing the cap 21 to be removed from the spout 11 and remaining attached to it. As shown in FIG. 10C and in more detail in FIG. 10D the ring member 33 is then moved to its upper position adjacent grip element 41 again to couple the cap 21 with the retaining member 113 at a position fully below the outlet tube 112. Conveniently, in this embodiment the protruding corners of the grip element 41, which are gripped by a user to open the cap 21, can be clamped in the retaining member 113 of the spout 11 to retain the cap 21 in the retaining position R.

Turning to FIGS. 11A to 11D, here the tethering member 31 is of a more substantial width than in the other embodiments and has a cut-out in the lower middle part thereof. As such, the tethering member 31 itself can be coupled with the retaining member 113 in the way shown in FIG. 11C. In the embodiment shown here again a ring member 33 which encloses the body of the cap 21 is used to allow the cap 21 to be removed from the spout 11 without the tethering member 31 elongating too much. When the cap 21 is then released (FIG. 11B) and moved to the retaining position R (FIGS. 11C and 11D), the tethering member 31 is hooked under the retaining member 113 that is formed on the spout 11, to retain the cap 21 in the retained position away from the outlet 112 of the spout.

Figure 12C:
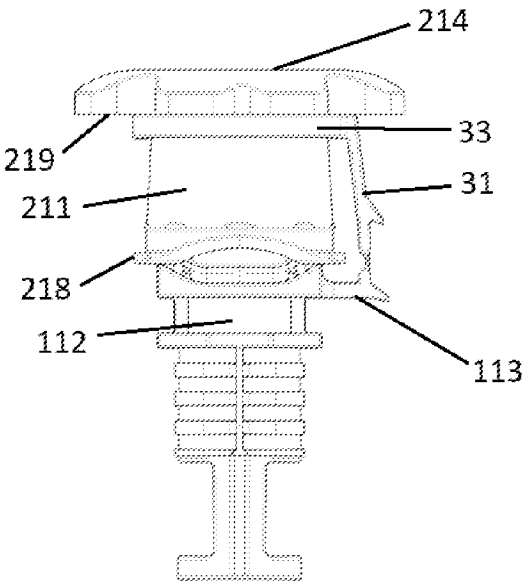
FIGS. 12A to 12E schematically show an eleventh embodiment of the spout-cap unit according to the present inventive concept.
Figure 12B:
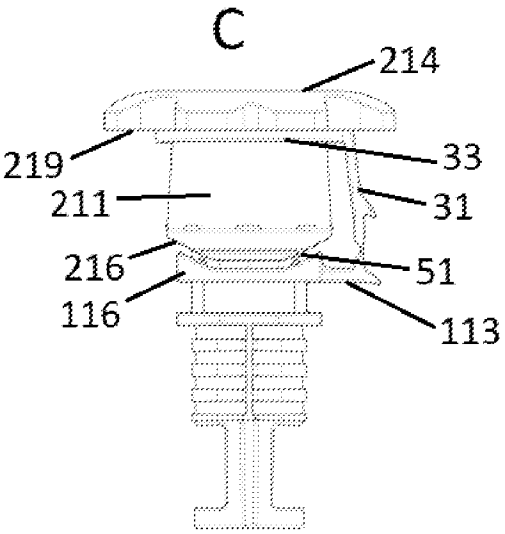
Figure 12A:
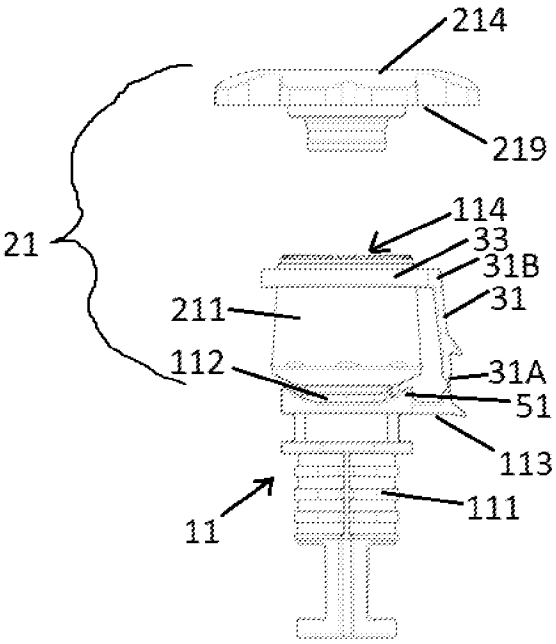

Shown in FIG. 12A is a cap-spout unit 1 that is made from two components: a plug element 214 and a spout-cap-assembly having an open cap body element 211. The spout-cap-assembly is made as a single injection moulding part, including sealboat 111, outlet tube 112, retaining member 113, cap body element 211 and retaining member 31, including ring element 33. It is noted that cap body element 211 and outlet tube 112 are separated from each other except for at the tamper evident connectors 51. It is also via these tamper evident connectors 51 that the cap body element 211 can be injection moulded. It is further noted that ring element 33 and cap body element 211 are separated from each other. FIG. 12A then shows the spout-cap-assembly with an open-ended cap and the outlet tube 112 of the spout part 11 left open. This advantageously allows the spout-cap-assembly to be sealed to a pouch before said pouch is filled.

In FIG. 12B, compared to FIG. 12A, plug element 219 is mounted onto the cap body element 211. As such the outlet 112 of the spout part 11 is closed and the cap 21 is formed. Attention is drawn to ramp 116 at the surface of the spout part 11 that faces the bottom of the cap part, notch 216 on the side of the cap part 21 and the tamper evident connectors 51 in between notch 216 and ramp 116. Turning now to FIG. 12C, the tamper evident connectors 51 can be broken by turning cap 21 and moving notch 216 up on the ramp 116. In this way, the cap 21 is unsealed. It is noted that in this unsealed position, the radial projection 219 of the cap 21, as defined by the plug element 214, contacts the ring element 33.

Figure 12E:
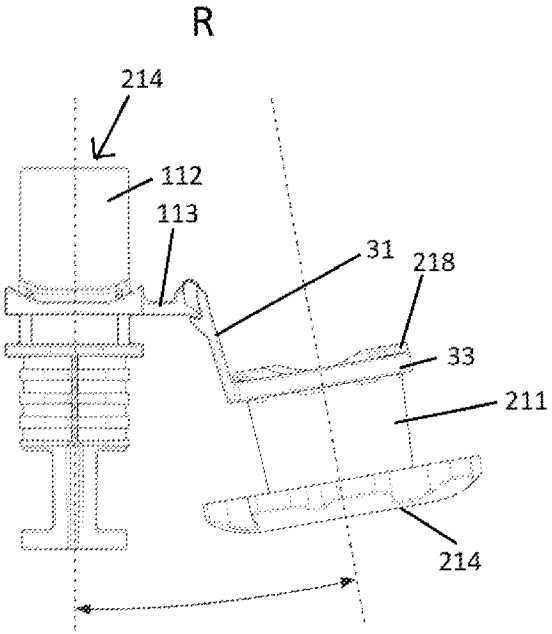
Figure 12D:
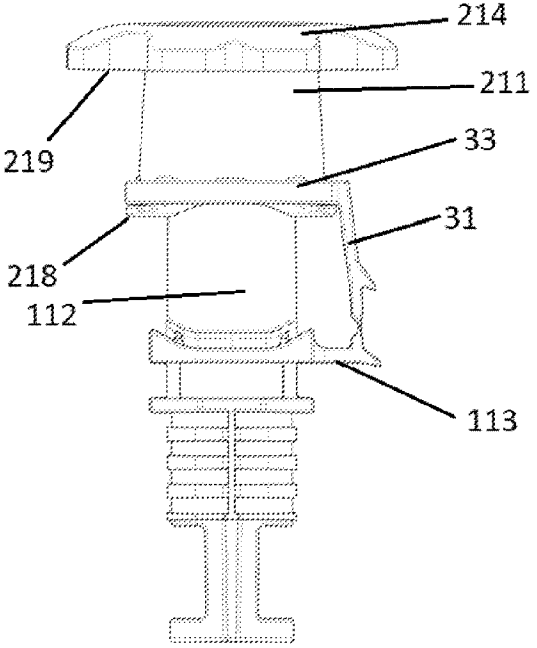

As shown in FIG. 12D, from the unsealed position as shown in FIG. 12C the cap 21 may be moved upwards with respect to the outlet tube 211. Even though the cap part 21 moves, it remains coupled with the spout part 11 as the ring element 33 of the tethering member 31 and the flange 218 of the cap part 21 together prevent the separation of cap 21 from spout 11.

From the upward cap position shown in FIG. 12D the cap part 21 may be rotated to the side, and free outlet tube 112. As shown, the cap part 21 may be manipulated towards a retaining position R in which the tethering member 31 is coupled with retaining member 113, to grip the cap in the retaining position R. It is noticed that both the lateral and the vertical separation between cap 21 and outlet tube 112 is quite large in the retained position R, with the cap 21 most notably being completely below the outlet tube 112. This makes it highly comfortable to drink from the outlet tube 112 without noticing the cap 21.

Figure 13:
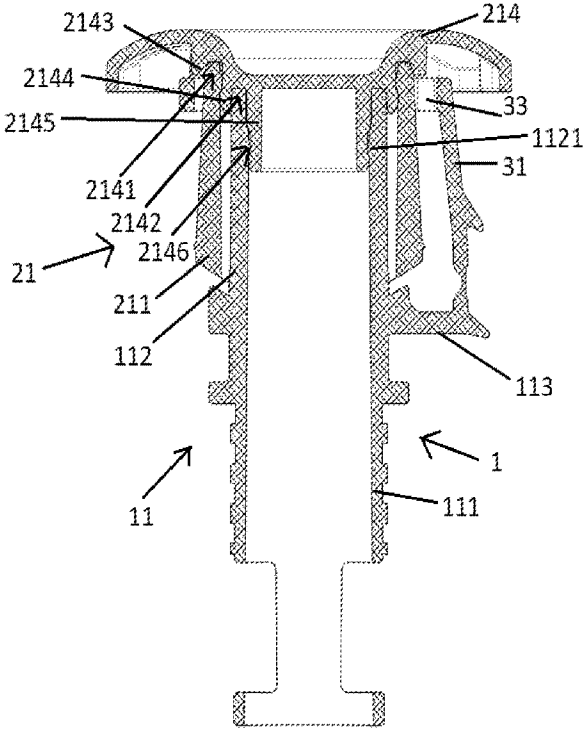
FIG. 13 schematically shows a cross-sectional view of the spout-cap unit according to FIGS. 12A to 12E.

FIG. 13 can be seen as a cross sectional view of FIG. 12B. As described, the spout-cap-assembly, including seal boat 111, outlet tube 112, retaining member 113, tethering member 31, ring element 33, cap body element 211 and tamper evident connectors are manufactured as one part, whereas the plug element 214 is manufactured as a separate part. Due to concentric annular grooves 2141, 2142 defined between inner walls 2144, 2145 and inner walls 2143, 2144 of the plug element 214, the plug element 214 may be connected with the spout-cap assembly. In particular, the connection between cap body element 211 and outer groove 2141 may be unreleasable, whereas the connection between outlet tube 112 and inner groove 2142 may be releasable—to allow the cap 21 to be separated from the outlet tube 112, but to prevent separation between plug element 214 and cap 21. Besides a connection between inner groove 2142 and the upper end of outlet tube 112, a further connection may be established between a circumferential recess 2146 at the most inner wall 2145 of the plug element 214 and a complementary circumferential projection 1121 at the inner wall of the outlet tube 112.

Advantageously, at least the spout-cap units 1 shown in FIGS. 7 to 13 can be transported in a "standard" spout transport rail as in use today, despite a tethering member 31 and a cap 21 being "added" to the spout 11 as compared to known spouts. This is an important requirement, as this allows the spout-cap unit 1 of the present inventive concept to be put to use in spout processing factories across the globe without the need for new equipment in said factories.

Whereas in the shown figures multiple embodiments of the spout-cap unit 1 have been shown, one skilled in the art of spouts, cap, and single-use containers will be able to define many more alternative embodiments, all falling within the inventive concept of the present inventive concept, which inventive concept is defined by the appended claims.

LIST OF REFERENCE NUMERALS

| | | | |
|---|---|---|---|
| 1 | spout-cap unit | | |
| | 11 | spout part | |
| | | 111 | sealboat |
| | | 112 | outlet tube |
| | | | 1121 circumferential protrusion |
| | | 113 | retaining member |
| | | 114 | outlet of outlet tube |
| | | 115 | surface facing bottom opening cap part |
| | | 116 | ramp |
| | 21 | cap part | |
| | | 211 | body element |
| | | 212 | top opening |
| | | 213 | bottom opening |
| | | 214 | plug element |
| | | | 2141 first annular groove |
| | | | 2142 second annular groove |
| | | | 2143 outer wall first groove |
| | | | 2144 inner wall first groove/outer wall second groove |
| | | | 2145 inner wall second groove |
| | | | 2146 circumferential recess |
| | | 215 | edge at bottom opening |
| | | 216 | notch in edge bottom opening |
| | | 217 | edge of notch |
| | | 218 | flange |
| | | 219 | radial projection |
| | 31 | tethering member | |
| | 32 | tethering member | |
| | 33 | ring element | |
| | 41 | grip element | |
| | 51 | tamper-evident connection | |
| | 52 | tamper-evident connection | |
| C | closed position cap | | |
| h | height cap part and tethering member | | |
| R | retained position cap | | |
| w | width cap part and tethering member | | |

CLAUSES

1. A spout-cap unit (1), comprising:
   - a spout part (11) including a sealboat (111), an outlet tube (112), and a retaining member (113); and
   - a cap part (21) for closing an outlet (114) of the outlet tube (112) in a closed position (C) of the cap part (21);
   - wherein the spout part (11) and the cap part (21) are tethered together via at least one tethering member (31, 32) to form the spout-cap unit (1), the tethering member (31, 32) being connected to the spout part (11) at one end (31A, 32A) of the tethering member (31, 32) and to the cap part (21) at the opposite end (31B, 32B) of the tethering member (31, 32),
   - wherein the cap part (21) is releasable from the outlet tube (114) of the spout part (11) for providing the cap part (21) in a released state (S),
     - wherein in said released state (S) the cap part (21) and the spout part (11) remain tethered together via the tethering member (31, 32), the tethering member (31, 32) allowing the cap part (21) to be moved to a retaining position (R) that is positioned away from the outlet (114) of the outlet tube (112),
   - wherein the cap part (21) or the tethering member (31, 32) can be coupled with the retaining member (113) of the spout part (11) for retaining the cap part (21) at the retaining position (R).

2. The spout-cap unit according to clause 1, wherein the cap part (21) and the spout part (11) are made from the same material.

3. The spout-cap unit according to clause 1 or 2, wherein the spout-cap unit (1) is injection moulded, preferably in a single injection moulding step.

4. The spout-cap unit according to any one of the preceding clauses, wherein the spout-cap unit (1) is made as a single part.

5. The spout-cap unit according to any one of the clauses 1-3, wherein the cap part (21) is composed out of at least two elements:
   - a body element (211) that is manufactured together with the spout part (11), the body element (211) enclosing the outlet tube (112) of the spout part (11) in a circumferential direction, the body element (211) connected to the tethering member (31, 32), and the body element (211) being hollow and having open ends (212, 213), and
   - a plug element (214) manufactured separately from the spout part (11) and the body element (211), the plug element (214) for closing an open end (212) of the body element (211), so that when the plug element (214) is received in the body element (211), the cap part (21) closes the outlet tube (112) of the spout part (11).

6. The spout-cap unit according to clause 5, wherein the plug element (214), on the side facing the cap part (21), comprises at least two concentric annular grooves (2141, 2142), each defined by a respective outer wall (2143, 2144) and a respective inner wall (2144, 2145), wherein the first (2141) of the at least two concentric annular grooves (2141, 2142) is arranged at the radially outer side with respect to the other (2142) of the at least two concentric annular grooves (2141, 2142) and is configured for a non-releasable connection with the body element (211) of the cap part (21), whereas the second (2142) of the at least two concentric grooves (2141, 2142) is arranged at the radially inner side and configured for a releasable connection with the outlet tube (112) of the spout part (11).

7. The spout-cap unit according to clause 6, wherein the inner wall (2144) of the first annular groove (2141) is longer than the respective outer wall (2143) thereof and/or wherein the inner wall (2145) of the second annular groove (2144) is longer than the respective outer wall (2144) thereof.

8. The spout-cap unit according to clause 6 or 7, wherein the inner wall (2144) of the first groove (2141) equals the outer wall (2144) of the second groove (2142).

9. The spout-cap unit according to any one of the clauses 6-8, wherein the inner wall of the second groove (2142) has a non-constant cross-sectional shape, with a circumferential recess (2146) at its radially outer surface, for receiving a circumferential protrusion (1121) arranged on the radially inner surface of the outlet tube (112).

10. The spout-cap unit according to any one of the preceding clauses, wherein an upper edge of the cap (21) has a diameter that is larger than a diameter of a body (211) of the cap (21), wherein the cap (21), near its lower edge, has a flange (218), and wherein a ring element (33) circumvents the body element (211) of the cap (21) and is moveable between the upper edge of the cap (21) and the flange (218), the tethering member (31, 32) being connected to said ring element (33).

11. The spout-cap unit according to any one of the preceding clauses, wherein the cap part (21) and the spout part (11) are free from screw thread.

12. The spout-cap unit according to any one of the preceding clauses, further comprising a grip element (41) attached to the cap part (21), the grip element (41), used by a user to remove the cap part (21) from its closed position (C).

13. The spout-cap unit according to any one of the preceding clauses, wherein the outer dimensions of the cap part (21) and the tethering member (31, 32) have a width (w) of at most 24 mm and/or have a height (h) of at most 19 mm.

14. The spout-cap unit according to any one of the preceding clauses, wherein a tamper-evident connection (51, 52) further connects the spout part (11) and the cap part (21) to each other when the cap part (21) has been unopened.

15. The spout-cap unit according to clause 14, wherein the tamper-evident connection (51) is connected to an outer surface of the cap part (21).

16. The spout-cap unit according to clause 14 or 15, wherein the tamper-evident connection (52) is connected to an inner surface of the cap part (21).

17. The spout-cap unit according to any one of the preceding clauses, comprising two tethering members (31, 32), each of the tethering members (31, 32) preferably having a substantially equal length.

18. The spout-cap unit according to any one of the preceding clauses, wherein the tethering member (31, 32) allows the cap part (21) to be twisted over an angle (y) of at most 120° with respect to the spout part (11).

19. The spout-cap unit according to any one of the preceding clauses, wherein the spout part (1) comprises a ramp (116) at the surface (115) that faces the bottom opening (213) the cap part (21), and wherein the edge (215) of the cap part (21) that faces the ramp (116) of the spout part (11) comprises a notch (216), a shape of the notch (216) matching the shape of the ramp (116), wherein the notch (216) preferably has a substantially straight edge (217) at one end thereof.

20. The spout-cap unit according to any one of the preceding clauses, wherein the retaining position (R) of the cap part (21) is located to the side of and/or below the closed position (C) of the cap part (21).

21. A pouch (61) comprising a spout-cap unit (1) according to any one of the preceding clauses.

22. A method for manufacturing the spout-cap unit (1) according to any one of the clauses 1-20 via injection moulding, wherein while filling the mould with a molten material, the cap part material is filled at least partially through the mould openings defining the tethering member.

What is claimed is:

1. A spout-cap unit (1), comprising:

a spout part including a sealboat, an outlet tube, and a retaining member; and a cap part for closing an outlet of the outlet tube in a closed position of the cap part;

wherein the spout part and the cap part are tethered together via at least one tethering member to form the spout-cap unit, the at least one tethering member being coupled with the spout part at one end of the at least one tethering member and with the cap part at an opposite end of the at least one tethering member, wherein the cap part is releasable from the outlet tube of the spout part for providing the cap part in a released state, wherein in the released state the cap part and the spout part remain tethered together via the at least one tethering member, the at least one tethering member allowing the cap part to be moved to a retaining position that is positioned away from the outlet of the outlet tube, wherein the cap part or the at least one tethering member is configured to be coupled with the retaining member of the spout part for retaining the cap part at the retaining position, and wherein the cap part comprises at least two elements:

a body element manufactured together with the spout part, the body element enclosing the outlet tube of the spout part in a circumferential direction, the body element coupled with the at least one tethering member, and the body element being hollow and having open ends, and a plug element manufactured separately from the spout part and the body element, the plug element for closing one of the open ends of the body element, so that when the plug element is received in the body element, the cap part closes the outlet tube of the spout part.

2. The spout-cap unit according to claim 1, wherein the plug element, on a side facing the cap part, comprises at least two concentric annular grooves, each defined by a respective outer wall and a respective inner wall, wherein a first of the at least two concentric annular grooves is arranged at a radially outer side with respect to a second of the at least two concentric annular grooves and is configured for a non-releasable connection with the body element of the cap part, wherein the second of the at least two concentric grooves is arranged at a radially inner side and configured for a releasable connection with the outlet tube of the spout part.

3. The spout-cap unit according to claim 2, wherein the inner wall of the first annular groove is longer than the respective outer wall thereof or wherein the inner wall of the second annular groove is longer than the respective outer wall thereof.

4. The spout-cap unit according to claim 2, wherein the inner wall of the first annular groove is the outer wall of the second annular groove.

5. The spout-cap unit according to claim 2, wherein the inner wall of the second annular groove has a non-constant cross-sectional shape, with a circumferential recess at a radially outer surface for receiving a circumferential protrusion arranged on a radially inner surface of the outlet tube.

6. The spout-cap unit according to claim 1, wherein the cap part and the spout part are made from a same material.

7. The spout-cap unit according to claim 1, wherein the spout-cap unit is injection molded.

8. The spout-cap unit according to claim 7, wherein the spout-cap unit is injection molded in a single step.

9. The spout-cap unit according to claim 1, wherein the plug element has a diameter that is larger than a diameter of a body of the cap, wherein the cap, near a lower edge, has a flange, and wherein a ring element surrounds the body element of the cap and is movable between an upper edge of the cap and the flange, the at least one tethering member being connected to the ring element.

10. The spout-cap unit according to claim 1, wherein the cap part and the spout part are free from screw thread.

11. The spout-cap unit according to claim 1, wherein outer dimensions of the cap part and the least one tethering member have a width of 24 mm or less or have a height of 19 mm or less.

12. The spout-cap unit according to claim 1, wherein a tamper-evident connection further connects the spout part and the cap part to each other when the cap part has been unopened.

13. The spout-cap unit according to claim 12, wherein the tamper-evident connection is connected to an outer surface of the cap part.

14. The spout-cap unit according to claim 1, wherein the spout part comprises a ramp at a surface that faces one of the open ends of the cap part, and wherein an edge of the cap part that faces the ramp of the spout part comprises a notch, a shape of the notch matching the shape of the ramp, wherein the notch preferably has a substantially straight edge at one end thereof.

15. The spout-cap unit according to claim 1, wherein in the retaining position, the cap part is located to a side of and below the cap part in the closed position.

16. A pouch comprising:

a spout-cap unit according to claim 1.

17. A spout-cap unit, comprising:

a spout part including a sealboat, an outlet tube, and a retaining member; and a cap part for closing an outlet of the outlet tube in a closed position of the cap part, the cap part comprising a flange at a lower edge, a radial projection at an upper edge, and a body element in between;

wherein the spout part and the cap part are tethered together via at least one tethering member to form the spout-cap unit, the at least one tethering member being connected to the spout part at one end of the at least one tethering member and comprising a ring element that encloses the cap part at an opposite end of the at least one tethering member, wherein the cap part is upwardly movable with respect to the outlet tube of the spout part and is releasable therefrom for providing the cap part in a released state, wherein in the released state the cap part and the spout part remain tethered together via the ring element of the at least one tethering member, the at least one tethering member allowing the cap part to be moved to a retaining position that is positioned away from the outlet of the outlet tube, and wherein the at least one tethering member can be coupled with the retaining member of the spout part for retaining the cap part at the retaining position.

* * * * *